United States Patent [19]

Lafontaine

[11] 3,942,073

[45] Mar. 2, 1976

[54] MOTOR OPERATED GARAGE DOOR MECHANISM

[76] Inventor: Florian Lafontaine, 10747 Hotel de Ville, Montreal Nord, Quebec, Canada

[22] Filed: Mar. 21, 1975

[21] Appl. No.: 560,623

[52] U.S. Cl. ..... 317/6; 49/28

[51] Int. Cl.[2] ..... E05F 15/12

[58] Field of Search ..... 317/6; 318/286; 49/28, 49/347, 349, 352

[56] References Cited

UNITED STATES PATENTS 3,633,313 1/1972 Lafontaine ..... 49/28 X

*Primary Examiner*—J. D. Miller

*Assistant Examiner*—Harry E. Moose, Jr.

[57] ABSTRACT

On a rotatable shaft, having no lateral movement in a housing, a slanted collar fixedly received thereon has a given rotational speed being driven by an electric motor. The collar drives two adjacent cylinders slidably received on the shaft, having interlocking slants and kept in working engagement with the collar by two compression springs. When the rotational speed of one of the cylinders differs from the given rotational speed of the collar this cylinder is pushed by the collar on a switch that shuts the motor off or reverses its polarity.

1 Claim, 4 Drawing Figures

MOTOR OPERATED GARAGE DOOR MECHANISM

FIELD OF THE INVENTION

The present invention relates to a motor operated garage door mechanism used to arrest the opening movement of a garage door should the door encounter an obstacle on its way up or to reverse its closing movement should the door encounter an obstacle on its way down.

BACKGROUND OF THE INVENTION

A very important requirement of the garage door operating mechanism is that it be absolutely safe in its operation, that is incapable of injuring any person using it or in vicinity thereof as it is being opened or closed, or of damaging any property that might be in the way of the door as it is automatically opened or closed.

STATEMENT OF THE INVENTION

It is therefore an object of this invention to provide a mechanism that will ensure the arrest of the opening movement of the garage door and the reversing of the closing movement of the garage door should the door encounter an obstacle on its way up or down.

The mechanism consists of a rotatable shaft, having no lateral movement in a housing, on which a slanted collar is fixedly received. This collar can be indirectly driven by an electric reversible motor through a worm gear reduction system or through a belt reduction system. The cylindric surface of the collar could be converted into a gear in working engagement with a worm locked on the shaft of the motor, or the worm gear could be fixedly received on the rotatable shaft but outside the housing; or a pulley could be fixedly received on the rotatable shaft outside the housing if a belt reduction system is to be used.

In residential operator, in order to lower the manufacturing cost, a plastic gear can be used with great success and a plastic gear does not have to run in oil. The use of a belt reduction drive in a residential operator offers some inconveniences: it takes more space and does not lock a one-piece door. In commercial operators space not being a problem a belt reduction drive is preferable, cost wise, to a worm gear running in oil.

The slanted collar being driven by the motor has a given rotational speed and drives two adjacent cylinders having interlocking slants, slidably received on the rotatable shaft and kept in working engagement with the collar by two compression springs.

When the rotational speed of one of the cylinders differs from the rotational speed of the collar this cylinder is pushed on a switch that shuts the motor off or reverses its polarity to stop or to reverse the movement of the door.

DESCRIPTION OF THE DRAWINGS

Other objects, purposes and characteristic features of the present invention will be in part obvious from the accompanying drawings, and in part pointed out as the description of the invention progresses. In describing the invention in detail reference will be made to the accompanying drawings in which like reference characters designate corresponding parts throughout the several views, and in which.

DESCRIPTION OF PREFERRED EMBODIMENT

Figure 1:
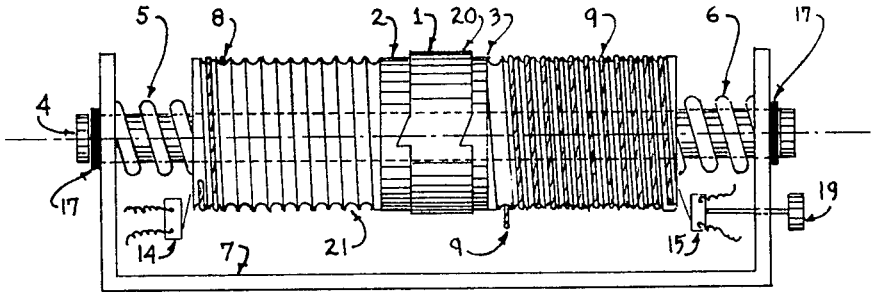
FIG. 1 is a front view of the mechanism made in accordance with the present invention.
Figure 2:
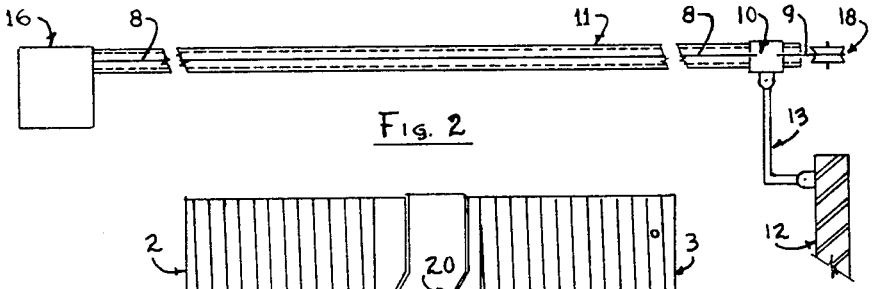
FIG. 2 is a schematic representation of a garage door opener, the enclosure 16 containing the mechanism of the present invention.
Figure 3:
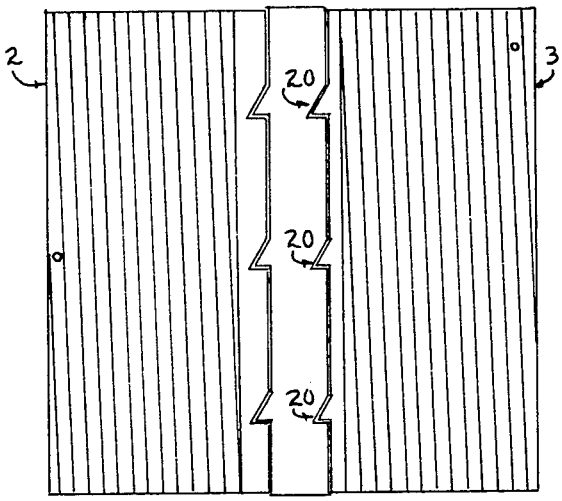
FIG. 3 represents the perimeter of the collar and the two adjacent cylinders, their surfaces being shown on a flat plan.
Figure 4:
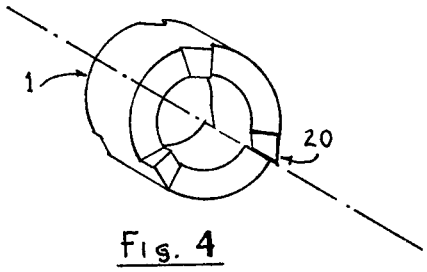
FIG. 4 represents a pan view of one end of the collar.

In a housing 7 a slanted collar 1 is fixedly received on a rotatable shaft 4 kept from having lateral movement by key means 17. Two cylinders 2 and 3 having interlocking slanted ends 20 are kept in working engagement with the collar 1 by two compression springs 5 and 6. The collar 1 is driven by an electric motor through a worm gear or belt reduction drive contained in enclosure 16. The cylinders 2 and 3 have an external thread type spiral groove 21 and two cables 8 and 9 operate in these grooves, the other end of the cables are attached to the carriage 10 sliding on track 11 and connected to the door 12 by an arm 13.

OPERATION OF PREFERRED EMBODIMENT

Assume that the door 12 is closed. When the motor is actuated the collar 1 starts turning with the shaft 4 and carries along the cylinder 2. The cable 8 winds around cylinder 2 while the cable 9 unwinds at the same time from cylinder 3. The cable pulls on carriage 10 and the door opens.

If in its way up the door encounters an obstacle the rotational speed of the cylinder 2 differs from the rotational speed of the collar 1. Due to their protuding slants the collar 1 pushes the cylinder 2 on the switch 14 which is connected to shut the motor off. It is preferable that the door stops when encountering an obstacle on its way up; if the door reverses, it might be dangerous if a car enters the garage before the door is fully opened. It is understood that other switches are used to stop the motor when the door is fully opened or fully closed.

Assume that the door is fully opened. When the motor is actuated the collar 1 starts turning in the other direction with the shaft 4 and carries along the cylinder 3. The cable 9 winds around cylinder 3 while the cable 8 unwinds from cylinder 2. The cable 9 going around the sheave 18 and being attached to the other end of the carriage 10 pulls on it and the door starts closing.

If the door encounters an obstacle in its way down the rotational speed of the cylinder 3 varies from the given rotational speed of the collar 1 and due to their protuding slanted sides collar 1 pushes cylinder 3 on the adjustable switch 15 which is connected to change the polarity of the motor and the door goes back up preventing injuries to person or damages to property. This switch 15 being adjustable, adjustment 19, the sensitivity to reverse the movement of the door coming down can be increased or decreased pending upon conditions of weather or of the door.

The foregoing description and accompanying drawings clearly disclose a preferred embodiment of this invention but it will be understood that the disclosure is merely illustrative and that changes may be made thereto without departing from the invention, the scope of which is only to be construed from the appended claim.

What I claim is:

1. A motor operated garage door mechanism used to arrest the opening movement of a garage door should the door encounter an obstacle on its way up or to reverse its closing movement should the door encounter an obstacle on its way down, comprising, in combination:

a housing; a shaft rotatively mounted in said housing; key means provided to prevent lateral movement of said shaft in said housing; a collar fixedly received on said shaft, said collar having a given rotational speed being driven by an electric reversing motor, said collar having protuding slants at opposite ends; two cylinders adjacent to said collar, said cylinders slidably received on said shaft and having protuding slants interlocking with the slants of said collar, said cylinders having a rotational speed proportioned to the given rotational speed of said collar, said cylinders having an external thread type spiral grooves; cable door closer actuating means operating in said grooves; a pair of adjustable limit switch means electrically connected to said motor and each oppositely disposed in a region adjacent to the extremities of said cylinders, said pair of limit switch means including a first limit switch for stopping said motor from rotating said collar and a second limit switch for causing said motor to reverse the rotation of said collar; a pair of compression springs means axially mounted on said shaft and disposed thereon on each side of said cylinders maintening said cylinders in working engagement with said collar, said cylinders being independently and longitudinally slidable on said shaft when the rotational speed of said cylinders varies from the given rotational speed of said collar whereby said pair of spring means allow one of the said cylinders when the rotational speed of said one cylinder differs from the given rotational speed of said collar to contact said first limit switch to stop the rotation of said collar when said one cylinder slides longitudinally away from said collar in one direction on said shaft and allow the other of the said cylinders when the rotational speed of said other cylinder differs from the given rotational speed of said collar to contact said second limit switch to reverse the rotation of said collar when said other cylinder slides longitudinally away from said collar in the other direction on said shaft.

* * * * *